US008979678B2

(12) United States Patent
Hogge et al.

(10) Patent No.: US 8,979,678 B2
(45) Date of Patent: Mar. 17, 2015

(54) COLOR GOLF BALL

(75) Inventors: Matthew F. Hogge, Plymouth, MA (US); Peter L. Serdahl, New Bedford, MA (US)

(73) Assignee: Acushnet Company, Fairhaven, MA (US)

( * ) Notice: Subject to any disclaimer, the term of this patent is extended or adjusted under 35 U.S.C. 154(b) by 893 days.

(21) Appl. No.: 12/972,709

(22) Filed: Dec. 20, 2010

(65) Prior Publication Data

US 2011/0086728 A1 Apr. 14, 2011

Related U.S. Application Data

(63) Continuation-in-part of application No. 12/359,619, filed on Jan. 26, 2009, which is a continuation-in-part of application No. 11/707,493, filed on Feb. 16, 2007, now Pat. No. 7,722,483.

(51) Int. Cl.

| | |
|---|---|
| ***A63B 37/06*** | (2006.01) |
| ***A63B 43/06*** | (2006.01) |
| ***A63B 37/00*** | (2006.01) |
| ***A63B 43/00*** | (2006.01) |

(52) U.S. Cl.

CPC ..... *A63B 43/06* (2013.01); *A63B 37/0003* (2013.01); *A63B 43/008* (2013.01); *A63B 37/0004* (2013.01); *A63B 37/0005* (2013.01); *A63B 37/0007* (2013.01); *A63B 37/0022* (2013.01); *A63B 37/0073* (2013.01)

USPC ..... 473/378

(58) Field of Classification Search

CPC ..... A63B 37/0029; A63B 37/007

USPC ..... 473/378

See application file for complete search history.

(56) References Cited

U.S. PATENT DOCUMENTS

| | | | | |
|---|---|---|---|---|
| 4,321,087 | A | 3/1982 | Levine et al. | |
| 4,615,940 | A | 10/1986 | Panush et al. | |
| 5,063,258 | A | 11/1991 | Babler | |
| 5,160,536 | A | 11/1992 | Harris et al. | |
| 5,427,378 | A | 6/1995 | Murphy | |
| 5,584,922 | A | 12/1996 | Babler | |
| 5,667,580 | A | 9/1997 | Babler | |
| 5,820,666 | A | 10/1998 | Babler | |
| 6,686,042 | B1 | 2/2004 | LeGallee | |
| 6,818,299 | B2 | 11/2004 | Phillips et al. | |
| 7,568,986 | B2 * | 8/2009 | Watanabe et al. | 473/378 |
| 2005/0123764 | A1 | 6/2005 | Hoffmann et al. | |
| 2007/0135234 | A1 * | 6/2007 | Nagasawa | 473/353 |

OTHER PUBLICATIONS

Silberline the global supplier of effect pigments, Jul. 28, 2000, Tamaqua, PA, www.siberline.com, 4pages.

Chromaflair, light interference pigments, Using ChromaFlair Pigments, Oct. 1997.

Chromapremier Chromalusion Colors, Dupont Automotive finishes, Oct. 2000.

(Continued)

*Primary Examiner* — Raeann Gorden

(74) *Attorney, Agent, or Firm* — Margaret C. Barker

(57) ABSTRACT

A golf ball comprising a core, a cover and an intermediate layer, wherein at least one of the core, intermediate layer and cover comprises a pigment, dye, or tint which contributes to an overall color appearance, the color having an a value, a b value and a hue angle value h expressed in the CIE CIECAM color system.

22 Claims, 1 Drawing Sheet

(56) References Cited

OTHER PUBLICATIONS

U.S.A. Luminum, Inc. Flemington, NJ, pp. 10-26. Oct. 28, 1999.
SpectraFlair Pigment Technology, www.colorshift.com, Commonly asked questions, pp. 1-2, Technical Description, pp. 1-2, Dec. 2001. Flex Products Inc., Santa Rosa, CA, 1997.
SpectraFlair Pigment Technology, Paint Formulation Guidelines, pp. 1-2, Dec. 2001.
SpectraFlair Pigment Technology, Durability in Paint, pp. 1-3, Feb. 2002.
New Special Effects Almost 'Mystical', Flex Products, Inc. Santa Rosa, CA. p. 22, Apr. 96.
The Functional Roles of Iriodin Mica-Based Pearlescent Pigments, by G. Houseman of the Pigment Division, E. Merck, Darmstadt, West Germany, Ink&Print May/Jun. 1990, pp. 8-10.
Vincentz, European Coatings Journal, Substrates for pearlescent pigments, Apr. 2003, p. 124.
Vincentz, European Coating Journal, Colour Measurement from Many Angles, Page Jun. 2005, p. 30.
The Nature of Helicone HC Color.
Pigments Offer Color Effects Watched Only by Nature, by Jorg Heinlein and Michael Kasch, Wacker Chemie GmbH, Burghausen, Germany, p. 58-61, Aug. 1999. www.pcimag.com.
Helicone HC XL, Organisches vernetztes Polymer/ Organic polymer network, Wacker Silicone, Munchen, www.wacker.de, 4pages.
Helicone HC, Organisches vernetztes Polymer/ Organic Polymer Network, Wacker Silicone, Wacker, Munchen, www.wacker.de, 4pages.
ChromaFlair L-Spec Light Interference Pigments, Seing Color in a Whole New Light, JDSU, www.jdsu.com, Nov. 2006, 6pages.
A New Generation of Sparkling Effect Pigments, Feature article Paint and coating, A New Generation of Sparkling Effect Pigments, Dr Raimund Schmid and Dr. Norbet Mronga/BASF AG, Ludwigshafen, Germany. pp. 1-5, Oct. 26, 2010.
Silberline, The Global Supplier of Effect Pigments, Tamaqua, PA, Jun. 27, 2001. 6 pages.
Chromaflair Light Interference Pigments, Standard color fan deck, Santa Rosa, CA, www.colorshift.com, 11 pages.
Chromaflair Light Interference Pigments, Santa Rosa, CA, 11 pages.
Chromaflair Light Interference Pigments, Thin-Film Interference Color, Absorption Color vs. Interference Color, Santa Rosa, CA., Jan. 1998.
Chromaflair Light Interference Pigments, www.colorshift.com.
Mearlite, Industrial Grade Pearlescent Pigments, Engelhard, Iselin, New Jersey, 1998, pp. 1-8.
Mearlin, Industrial Grade Pearlescent Pigments, Englehard, Iselin, New Jersey, 1998, pp. 1-8.
Mearl, Mearl Pearlescent Pigments for use in Coatings, Briarcliff manor, NY, 1996, pp. 1-16.
Mearl, Mearl Pearlescent Pigments for use in Coatings, Briarcliff Manor, NY, 1993, pp. 1-16.
Mearl, Mearl Pearlescent Pigments for use in Plastics, Briarcliff Manor, NY, 1992, pp. 1-16.
Mearl, Mearl Pearlescent Pigments for use in Printing Inks, Briarcliff Manor, NY, 1995, pp. 1-16.
Mearl, Mearl Pearlescent Pigments for us in printing Inks, Briarcliff Manor, NY, 1988, pp. 1-14.
Mearl, Mearlite Industrial Grade Pearlescent Pigments, New York, NY, Jun. 1993, pp. 1-4.
Mearl, Pearlescent and Iridescent Luster Pigments, Briarcliff Manor, NY, 1989, pp. 1-4.
BASF The Chemical Company, High-quality, high-performance pigments, Florham Park, NJ, www.basf.com, 1997, pp. 1-8.
Powder Coating, vol. 8, No. 6, Sep. 1997, Your Guide to Powder Coating '97, Paul J. Nowark, Engelhard Corporation, Iselin, NJ, pp. 1-7.
Create a Difference Special Effect Pigments, Engelhard, 1999, Iselin, NJ, pp. 1-6.
Wacker Silicone, Helicone HC The Smart Color Concept, Jun. 2000, pp. 1-12.
Why have only one color When you can have them all? by David M. Grafflin and Paul J. Nowark, Aug. 2001, www.pcimag.com, pp. 34-38.
Market Place article, Paint & Coating Industry, Circle No. 22. By Edward W. Bourguignon, President, Posintel Inc., East Cleveland ,OH. p. 33.
Mill Mates, Your Mill's Best Friend. Zircoa, Solon, OH, www.zircoa.com, Circle No. 23.
Pigments offer Color Effects Matched Only by Nature, by Jorg Heinlein and Michael Kasch, Wacker Chemie Gmbi-I, Burghausen, Germany, Jun. 2000, pp. 58-61.
Helicone HC, Organisches vernetztes Polymer/Organic Polymer Network, Wacker Silicone, 2000, pp. 4.
Science Links Japan, Feb. 24, 2010.
Mearl, Creative Inspirations, Pearlescent Pigments and Iridescent colors for Industrial Applications, pp. 4.
SpectraFlair Pigment Technology, Silver 1400 Fan Deck, Santa Rosa, CA, www.colorshift.com.
Engelhard, Color Palet, Iselin, NJ., www.engelhard.com.
Engelhard, Engelhard Special Effect Pigments, www.engelhard.com, 2004, 8pages.
Silberline, Tamaqua, PA., Product data sheet, GP-188SV Holographic Flake, Jun. 27, 2001.
Silberline, Tamaqua, PA., Product data sheet, GP-122SV Holographic Flake, Jun. 27, 2001.
Blasberry Prizm, Chromalusion Colors, Dupont Automotive Finishes, 4 pages.
Prizmatique colors, PPG.
Geometric Pigment, Silberline, Tamaqua, PA.
Mearl, Mearlin Pearlescent & Iridescent Luster Pigments for Screen Printing Inks, Iselin, NJ, Feb. 1994 pp. 6.
Chromaflair, ColorShift Idea Palette—vol. 3 based on red/gold 000, Santa Rosa, CA., www.colorshift.com, 8 pages.
Mearl, New Product Information, Mearlin MagnaPearl Luster Pigments, Briarcliff Manor, NY., 2 pages.
Research Article Colour Vision Model-Based Approach for Segmentation of Traffic Signs, Hindawi Publishing Corporation, EURASIP Journal on Image and Video Processing vol. 2008, Article ID 386705, 7 pages.
F. Szabo et al, A Comparative Sudy of New Solid State Light Sources, by Ferenc Szabo, Janos Schanda, Peter Bodrogi, and Emil Radkov, University of Pannonia Hungary, Lumination, LLC, USA, 4 pages.
Handprint, Comparison of hue circles, www.handprint.com/HP/WCL/vismixmap.html, Oct. 29, 2010, 15 pages.
Handprint, Modern Color Models, http://www.handprint.com/HP/WCL/color7.html, Oct. 29, 2010, pp. 82.

* cited by examiner

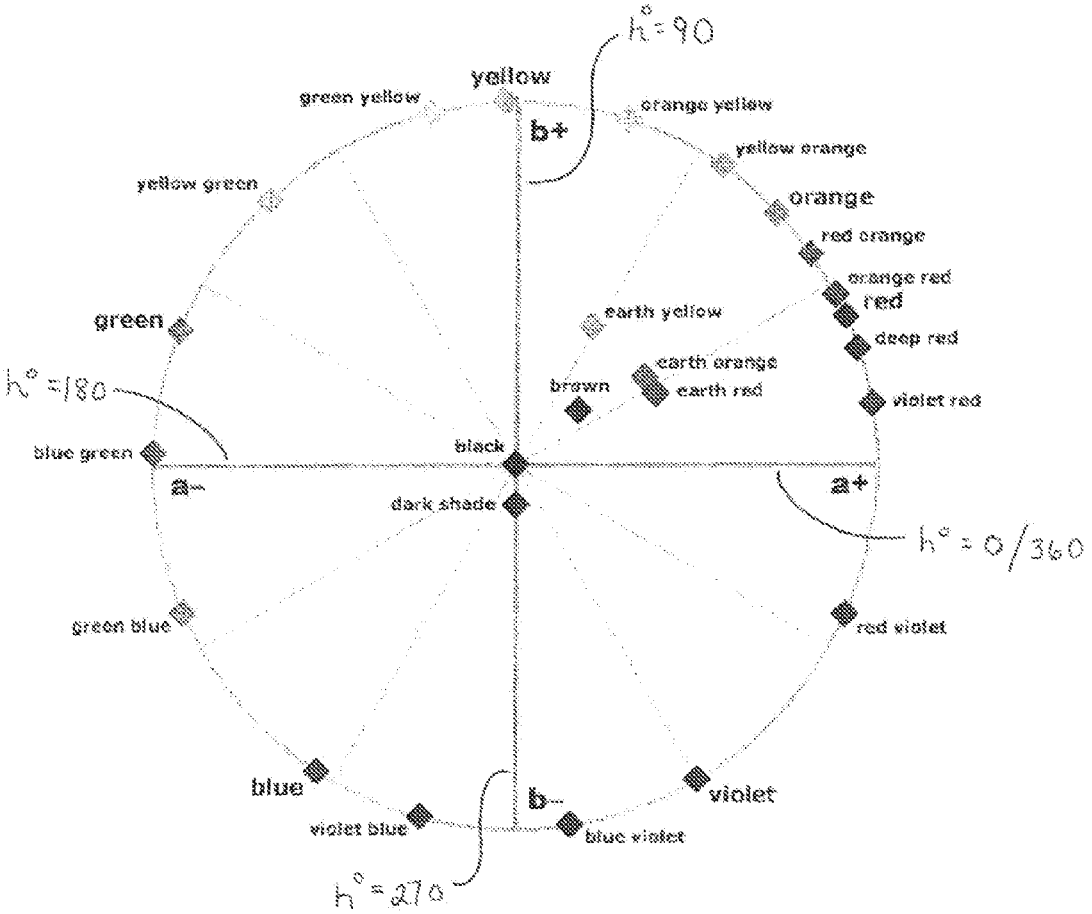
h° = 90
yellow
green yellow
orange yellow
b+
yellow orange
yellow green
orange
red orange
orange red
red
green
earth yellow
deep red
earth orange
h° = 180
brown
earth red
violet red
blue green
black
a−
a+
dark shade
h° = 0/360
green blue
red violet
blue
violet
b−
violet blue
blue violet
h° = 270

COLOR GOLF BALL

CROSS-REFERENCE TO RELATED APPLICATION

This application is a continuation-in-part of co-pending U.S. patent application Ser. No. 12/359,619, filed Jan. 26, 2009, now U.S. Publ. No. 20090137343, which is a continuation-in-part of U.S. patent application Ser. No. 11/707,493, filed on Feb. 16, 2007, now U.S. Pat. No. 7,722,483, each of which is incorporated by reference herein in its entirety.

FIELD OF THE INVENTION

The invention relates generally to colored golf balls comprising a pink or purple pigment, dye or tint such that a human's eye will perceive the overall colored golf ball equally favorably under varied viewing conditions due to, for example, changed daylight, weather and/or background against which the golf ball lies.

BACKGROUND OF THE INVENTION

Golf balls, whether of solid or wound construction, generally include a core and a cover. It is known in the art to modify the properties of a conventional solid ball by altering the typical single layer core and single cover layer construction to provide a ball having at least one mantle layer disposed between the cover and the core. The core may be solid or liquid-filled, and may be fanned of a single layer or one or more layers. Covers, in addition to cores, may also be formed of one or more layers. These multi-layer cores and covers are sometimes known as "dual core" and "dual cover" golf balls, respectively. Additionally, many golf balls contain one or more intermediate layers that can be of solid construction or may be formed of a tensioned elastomeric winding, which are referred to as wound balls. One piece golf balls are even available. The difference in play characteristics resulting from these different types of constructions can be quite significant. The playing characteristics of multi-layer balls, such as spin and compression, can be tailored by varying the properties of one or more of these intermediate and/or cover layers.

Meanwhile, color in a golf ball, being a dominant visual feature, also positively contributes to and enhances a golfer's game by improving the player's ability to focus on the golf ball when swinging a club and striking the ball. By keeping an eye on the ball, the golfer is able to remain focused on the immediate task at hand of maintaining hand-eye coordination and producing great balance during swing with consistent spine angle in order for the club face to strike the golf ball with just the right force, depending on the chosen club and desired distance.

Accordingly, it is desirable that a golfer's eye perceive the same golf ball color shade equally favorably under varied viewing conditions. Yet, sometimes a golfer's perception of a certain color shade will vary considerably with changed viewing conditions. In this regard, the time of day that a golf game is played may vary the viewing conditions as it is usually much brighter during a game played in the midday sun than one played at dusk. Another factor which may affect viewing conditions is weather—on a sunny day, the human golfer's eye will perceive some golf ball color shades differently than on an overcast or even rainy day. Meanwhile, the color of the background against which the golf ball lies (e.g., teeing ground versus on fairway, rough or hazard) will change how the golfer's eye perceives some golf ball color shades.

Therefore, golf ball manufacturers desire to choose golf ball color shades which are most likely to produce the least variance in a golfer's perception of that color with changed viewing conditions and will appear most favorably to the golfer under a wide range of different viewing conditions.

Manufacturers, in choosing and defining golf ball color, have previously utilized color systems such as the CIELAB (1976) color space wherein color is defined under only one lighting condition or illuminant, namely D65. Such single lighting condition models present a significant drawback for choosing golf ball color, however, in that they fail to consider, address or account for how changing stimuli on the green will affect a golfer's visual perception of color and are therefore not practical or reliable systems for choosing appropriate golf ball color shades.

Accordingly, there is a need for a golf ball having an overall golf ball color which golfers will visually perceive most favorably under a wide range of golf course viewing conditions based on a color appearance model which takes into account the effect of varying viewing conditions on the human eye's perception of golf ball color shades.

SUMMARY OF THE INVENTION

The present invention is directed to a golf ball having an overall golf ball color of pink or purple comprising a core, a cover and an intermediate layer, wherein at least one of the core, intermediate layer and cover comprises a pigment, dye, or tint which contributes to the color, the color having an a value, a b value and a hue angle value h expressed in the CIE CIECAM color system, wherein: where the a value is from about 5 to about 57, then the b value is from about −1 to about −60 and the hue angle h is from about 271° to about 359°; and where the a value is from about 58 to about 95, then the b value is from about 1 to about 60 and the hue angle h is from about 1° to about 35°.

In another embodiment, a golf ball having an overall golf ball color of pink or purple comprises a core, a cover and an intermediate layer disposed between the core and the cover, wherein the cover is at least partially transparent and at least one of the cover and the intermediate layer comprises a pigment, dye or tint which contributes to the color, said color having an a value, a b value and a hue angle value h expressed in the CIE CIECAM color system, wherein: where the a value is from about 5 to about 57, then the b value is from about −1 to about −60 and the hue angle h is from about 271° to about 359°; and where the a value is from about 58 to about 95, then the b value is from about 1 to about 60 and the hue angle h is from about 1° to about 35°.

In yet another embodiment, a golf ball having an overall golf ball color of pink or purple comprises a core, a cover and an intermediate layer disposed between the core and the cover, wherein the intermediate layer comprises a pigment or dye which contributes to the color, wherein the cover comprises a translucent material and a pigment or dye which contributes to the color, and wherein the surface of said cover is coated with a coating material which is at least partially transparent and comprises a tint which contributes to the color, the color having an a value, a b value and a hue angle value h expressed in the CIE CIECAM color system, wherein: where the a value is from about 5 to about 57, then the b value is from about −1 to about −60 and the hue angle h is from about 271° to about 359°; and where the a value is from about 58 to about 95, then the b value is from about 1 to about 60 and the hue angle h is from about 1° to about 35°.

In still another embodiment, a golf ball having an overall golf ball color of pink or purple comprises a core and a cover, wherein the cover comprises a pigment or dye which contributes to the color, and wherein the surface of said cover is coated with a coating material which is at least partially transparent and comprises a tint which contributes to the color, the color having an a value, a b value and a hue angle value h expressed in the CIE CIECAM color system, wherein: where the a value is from about 5 to about 57, then the b value is from about −1 to about −60 and the hue angle h is from about 271° to about 359°; and where the a value is from about 58 to about 95, then the b value is from about 1 to about 60 and the hue angle h is from about 1° to about 35°.

In a further embodiment, a golf ball having an overall golf ball color of pink or purple comprises a core and a cover wherein at least one of the core and the cover comprises a pigment, dye or tint which contributes to the color such that the color has an a value, a b value and a hue angle value h expressed in the CIE CIECAM color system, wherein: where the a value is from about 5 to about 57, then the b value is from about −1 to about −60 and the hue angle h is from about 271° to about 359°; and where the a value is from about 58 to about 95, then the b value is from about 1 to about 60 and the hue angle h is from about 1° to about 35°.

The invention also pertains to a one piece golf ball having an overall golf ball color of pink or purple comprising a single solid sphere and a coating wherein at least one of the sphere and the coating comprises a pigment, dye or tint which contributes to the color such that the color has an a value, a b value and a hue angle value h expressed in the CIE CIECAM color system, wherein: where the a value is from about 5 to about 57, then the b value is from about −1 to about −60 and the hue angle h is from about 271° to about 359°; and where the a value is from about 58 to about 95, then the b value is from about 1 to about 60 and the hue angle h is from about 1° to about 35°.

In any or all of the embodiments disclosed or claimed herein, the overall golf ball color may also have a J lightness value expressed in the CIE CIECAM color system of from about 15-90 and/or a C chroma value expressed in the CIE CIECAM color system of from about 30 to about 90. Alternatively, the overall golf ball color may have a J lightness value expressed in the CIE CIECAM color system of from about 40-90 and/or a C chroma value expressed in the CIE CIECAM color system of from about 50 to about 90.

Other embodiments for each of the ball constructions described above are envisioned wherein the CIECAM color values for the overall golf ball are as follows. The color may alternatively have an a value, a b value and a hue angle value h expressed in the CIE CIECAM color system, wherein: where the a value is from about 52 to about 58, the b value is from about −30 to about 30 and the hue angle h is either from about 330° to about 359° or from about 1° to about 30°.

The cover may comprise thermoset and/or thermoplastic materials. The cover may comprise materials selected, for example from the group comprising polyurethane, polyurea, and ionomer resins. The cover may comprise a material which is at least partially translucent, transparent, or pearlescent. In one embodiment, both the cover and intermediate layer comprise a material which is at least partially translucent, transparent, or pearlescent. The cover may further comprise particulate material selected from the group comprising metal flake, iridescent glitter, metalized film and colored polyester foil.

In one embodiment, the pigment, dye or tint may be fluorescent. The pigment, dye or tint may also or instead be inorganic or organic.

Herein, the term "overall golf ball color" refers to the color of a finished golf ball as perceived by the golfer according to the CIECAM color appearance model parameters disclosed herein.

The term "pink" includes/refers to any color which satisfies the CIECAM system parameter values described or set forth herein and may be used interchangeably with other common similar color terms which may also satisfy these parameters, including for example without limitation light crimson or pale reddish purple.

The term "purple" includes/refers to any color which satisfies the CIECAM system values/parameters described or set forth herein and may be used interchangeably with other common similar color terms which may also satisfy these parameters including for example, without limitation, violet, lilac, indigo, reddish violet, or blue violet.

A golf ball of the invention incorporates color using the CIE CIECAM color appearance model which was developed based on human perception and permits the golf ball manufacturer to accurately predict how the average golfer will perceive a specific overall golf ball color shade under different viewing conditions. In this way, it becomes possible for a golf ball manufacturer to identify and incorporate into a golf ball only those color shades which are most likely to produce the least variance in a golfer's perception of color in response to the expected changes to stimuli on the golf course and therefore be most appealing to the golfer's eye under a variety of viewing circumstances.

BRIEF DESCRIPTION OF THE DRAWINGS

FIG. 1 depicts a CIECAM hue circle as described herein.

DETAILED DESCRIPTION

The present invention is directed to a golf ball comprising at least a core or a multi-piece core and a cover. The cover may comprise a translucent or transparent material that can be cast, injection molded, compression molded or reaction injection molded over a golf ball precursor or subassembly. Additionally, the cover comprises a plurality of dimples on its surface. The golf ball may also comprise an intermediate layer between the core and the cover. As taught in parent U.S. patent application Ser. No. 11/707,493 (published as US 2007/0149323), which has been incorporated by reference in entirety, the cover may comprise a substantially optically transparent or translucent material, so that the intermediate layer or core contributes to the color characteristics of the ball. The intermediate layer or core may be white, transparent or translucent, colored, or may have a multi-colored pattern. The intermediate layer may be opaque, transparent or translucent, or be white or comprise one or more colors. The cover may be translucent and may comprise an amount of pigment or dye, creating a colored but translucent cover under which the intermediate or outer core layer is visible. In this embodiment, the intermediate layer, which can be an outer core layer, may be colored or may comprise a pattern that is visible through the translucent outer cover. The intermediate or outer core layer may also be printed with indicia or other markings that may be viewed through the clear or translucent cover. The cover may also comprise an amount of reflective particulates to create a pearlescent or sparkle effect.

The colored core, intermediate layer, cover or coating of any embodiment herein embodiment may be pink, light crimson, pale reddish purple, lilac, purple, indigo, violet, for example. Additionally, golf balls of the present invention having partially translucent covers and an amount of dye or pigment would incorporate the same colors in accordance with the CIE CAM color model parameters disclosed herein.

Under the CIECAM model, J represents the lightness of a color and varies from 0 (or black) to 100 (or white). C or Chroma represents the intensity of the color, which may range from 0 (or neutral) to 81-95 or greater. The color being very intense to supersaturated. The diagram set forth in FIG. 1 represents the CIECAM hue circle and displays the hue angle for each color beginning at O° (a+) and moving counterclockwise around the CIECAM hue circle. For example, in the CIECAM hue circle of FIG. 1, "violet red" appears at approximately 12° on the wheel below.

On the CIECAM hue circle of FIG. 1, measurements from center (or black) to each of a+, a− and b+ or b− range from 0-100 horizontally and vertically, respectively. Accordingly, for example, the a, b values for "violet red" located in the hue wheel below at about hue angle 12° would be about a+=about 80 and b+=about 80. The hue circle of FIG. 1 is as presented at www.handprint.com© Bruce MacEvoy. Bruce MacEvoy measured and plotted the relationship of watercolor pigments on the CIECAM $a_c b_c$ chroma based hue plane.

Herein, the term "color" constitutes the color of the overall finished golf ball as perceived by the golfer. Thus, in a golf ball of the invention, the intermediate layer and/or cover layer may each contribute to the final overall color appearance. For example, the intermediate layer may contribute a red color and the cover layer may contribute a blue color to form a golf ball which a golfer perceives as a violet color golf ball as defined within the CIECAM color model. Alternatively, the intermediate layer may contribute a blue color and the cover layer may contribute a red color to form a golf ball which a golfer perceives as a purple golf ball as defined within the CIECAM color model within the parameter disclosed herein. In a different embodiment, the intermediate layer may contributes a shade 1 violet and the cover layer may contribute a shade 2 violet to form a golf ball which a golfer perceives as a shade 3 violet as defined within the CIECAM color model parameters disclosed herein. Meanwhile, either the intermediate layer or cover layer may solely contribute a violet color or pink color to the final overall golf ball color appearance.

The present invention is directed to a golf ball comprising color shades which the golfer will perceive most favorably irrespective of changed viewing conditions. The golf ball of the invention incorporates color shades into a golf ball according to a color model which accounts for/considers a human's varied perception of color shades according to certain expected changes to the stimuli, such as the weather changing from sunny to cloudy, or the golfer playing at different times of day, or the golf ball being struck on different colored playing surfaces.

A golf ball of the invention incorporates color using the CIECAM color appearance model which was developed based on human perception and permits the golf ball manufacturer to accurately predict how the average golfer will perceive a specific golf ball color shade under different conditions. In this way, it becomes possible for the golf ball manufacturer to identify and incorporate into a golf ball only those color shades which remain most visually desirable to the golfer under a wide range of changed viewing conditions as well as are most likely to produce the least variance in a golfer's perception of color in response to the expected changes to stimuli on the golf course.

The golf ball of the invention incorporates colors taking into account the tristimulus values (X, Y and Z) of the stimulus, its background, its surround, the adapting stimulus, the luminance level, and other factors such as cognitive discounting of the luminant. The model includes correlates for perceptual attributes including brightness, lightness, colorfulness, chroma, saturation and hue.

The core may be a wound core, which is visible through the clear or translucent cover. The uneven surface of the wound core creates a unique visual effect, as the crevices and ledges created by the wound elastomeric material create shadows visible through the clear or translucent cover. An intermediate layer may be disposed around the wound core. In this instance, the intermediate layer is visible through the clear or translucent cover and may be white, colored, or comprise multiple colors as disclosed herein in various patterns.

A cover of the golf ball of the present invention may comprise surface off-sets, or depressions or projections, on its surface. Surface off-sets include dimples and marking other than dimples. For instance, the surface of the translucent cover may comprise depressed logos, text, lines, arcs, circles or polygons. The surface may also comprise raised projections in the form of logos, text, lines, arcs, circles or polygons. The inclusion of such surface off-sets on the translucent cover creates a unique visual effect, as the juxtaposition of thick and thin portions of the translucent cover material creates a "shadow" effect on the opaque surface below the translucent cover.

The cover of the golf ball of the present invention may have a thickness between 0.02 and 0.1 inch. More preferably, the cover has a thickness between 0.02 and 0.08 inches. Most preferably, the cover has a thickness between 0.025 and 0.07 inches. Additionally, the golf ball preferably has a coefficient of restitution of at least 0.700 and an Atti compression between 50 and 120. The thickness of the intermediate layer may be between 0.01 and 0.06 inches. More preferably, the intermediate layer has a thickness between 0.02 and 0.055 inches. Most preferably, the intermediate layer has a thickness between 0.03 and 0.05 inches. The core of the golf ball of the present invention may have a diameter between 0.5 and 1.62 inches. More preferably, the core has a thickness between 0.8 and 1.61 inches. Most preferably, the core has a thickness between 1.0 and 1.6 inches.

Preferably, a cover of the present invention is made from thermoplastic and thermoset materials, preferably polyurethane, polyurea, and ionomer resins.

Polyurethane that is useful in the present invention includes the reaction product of polyisocyanate, at least one polyol, and at least one curing agent. Any polyisocyanate available to one of ordinary skill in the art is suitable for use according to the invention. Exemplary polyisocyanates include, but are not limited to, 4,4'-diphenylmethane diisocyanate ("MDI"), polymeric MDI, carbodiimide-modified liquid MDI, 4,4'-dicyclohexylmethane diisocyanate ("$H_{12}$MDI"), p-phenylene diisocyanate ("PPDI"), m-phenylene diisocyanate ("MPDI"), toluene diisocyanate ("TDI"), 3,3'-dimethyl-4,4'-biphenylene diisocyanate ("TODI"), isophoronediisocyanate ("IPDI"), hexamethylene diisocyanate ("HDI"), naphthalene diisocyanate ("NDI"); xylene diisocyanate ("XDI"); p-tetramethylxylene diisocyanate ("p-TMXDI"); m-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; isocyanurate of HDI; triisocyanate of 2,4,4-trimethyl-1,6-hexane diisocyanate ("TMDI"), tetracene diisocyanate, napthalene diisocyanate, anthracene diisocyanate, and mixtures thereof. Polyisocyanates are known to those of ordinary skill in the art as having more than one isocyanate group, e.g., di-, tri-, and tetra-isocyanate. The polyisocyanate may include $H_{12}$MDI, MDI, PPDI, TDI, or a mixture thereof. It should be understood that, as used herein, the term "MDI" includes 4,4'-diphenylmethane diisocyanate, polymeric MDI, carbodiimide-modified liquid MDI, and mixtures thereof and, additionally, that the diisocyanate employed may be "low free monomer," understood by one of ordinary skill in the art to have lower levels of "free" isocyanate monomer, typically less than about 0.1 percent to about 0.5 percent free monomer. Examples of "low free monomer" diisocyanates include, but are not limited to Low Free Monomer MDI, Low Free Monomer TDI, Low Free MPDI, and Low Free Monomer PPDI.

The at least one polyisocyanate should have less than about 14 percent unreacted NCO groups. Preferably, the at least one polyisocyanate has less than about 7.9 percent NCO, more preferably, between about 2.5 percent and about 7.8 percent, and most preferably, between about 4 percent to about 6.5 percent. In an alternative embodiment, the at least one polyisocyanate could have more than about 14 percent unreacted NCO groups, which would be suitable if the golf balls are made by means of reaction injection molding (RIM).

As used herein, the term "percent NCO" or "% NCO" refers to the percent by weight of free, reactive, and unreacted isocyanate functional groups in an isocyanate-functional molecule or material. The total formula weight of all the NCO groups in the molecule or material, divided by its total molecular weight, and multiplied by 100, equals the percent NCO.

Any polyol available to one of ordinary skill in the art is suitable for use according to the invention. Exemplary polyols include, but are not limited to, polyether polyols, hydroxy-terminated polybutadiene and partially/fully hydrogenated derivatives, polyester polyols, polycaprolactone polyols, and polycarbonate polyols. In one preferred embodiment, the polyol includes polyether polyol, more preferably those polyols that have the generic structure:

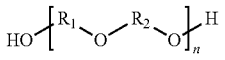

where $R_1$ and $R_2$ are straight or branched hydrocarbon chains, each containing from 1 to about 20 carbon atoms, and n ranges from 1 to about 45. Examples include, but are not limited to, polytetramethylene ether glycol, polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material of the invention. Preferred polyester polyols have the generic structure:

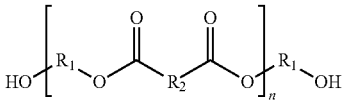

where $R_1$ and $R_2$ are straight or branched hydrocarbon chains, each containing from 1 to about 20 carbon atoms, and n ranges from 1 to about 25. Suitable polyester polyols include, but are not limited to, polyethylene adipate glycol, polybutylene adipate glycol, polyethylene propylene adipate glycol, ortho-phthalate-1,6-hexanediol, and mixtures thereof. The hydrocarbon chain can have saturated or unsaturated bonds, or substituted or unsubstituted aromatic and cyclic groups.

In another embodiment, polycaprolactone polyols are included in the materials of the invention.

Preferably, any polycaprolactone polyols have the generic structure:

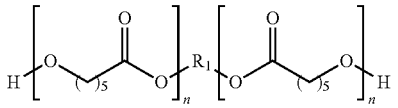

where $R_1$ is a straight chain or branched hydrocarbon chain containing from 1 to about 20 carbon atoms, and n is the chain length and ranges from 1 to about 20. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, the polycarbonate polyols are included in the polyurethane material of the invention. Preferably, any polycarbonate polyols have the generic structure:

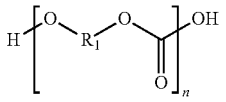

where $R_1$ is predominantly bisphenol A units -(p-$C_6H_4$)—C($CH_3$)$_2$-(p-$C_6H_4$)— or derivatives thereof, and n is the chain length and ranges from 1 to about 20. Suitable polycarbonates include, but are not limited to, polyphthalate carbonate. The hydrocarbon chain can have saturated or unsaturated bonds, or substituted or unsubstituted aromatic and cyclic groups. In one embodiment, the molecular weight of the polyol is from about 200 to about 4000.

Polyamine curatives are also suitable for use in the polyurethane composition of the invention and have been found to improve cut, shear, and impact resistance of the resultant balls. Preferred polyamine curatives have the general formula:

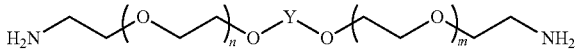

where n and m each separately have values of 0, 1, 2, or 3, and where Y is ortho-cyclohexyl, meta-cyclohexyl, para-cyclohexyl, ortho-phenylene, meta-phenylene, or para-phenylene, or a combination thereof. Preferred polyamine curatives include, but are not limited to, 3,5-dimethylthio-2,4-toluenediamine and isomers thereof (trade name ETHACURE 100 and/or ETHACURE 100 LC); 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); trimethylene glycol-di-p-aminobenzoate; polytetramethyleneoxide-di-p-aminobenzoate; N,N'-dialkyldiamino diphenyl methane; para, para'-methylene dianiline (MDA), m-phenylenediamine (MPDA), 4,4'-methylene-bis-(2-chloroaniline) (MOCA), 4,4'-methylene-bis-(2,6-diethylaniline), 4,4'-diamino-3,3'-diethyl-5,5'-dimethyl diphenylmethane, 2,2',3,3'-tetrachloro diamino diphenylmethane, 4,4'-methylene-bis-(3-chloro-2,6-diethylaniline), (LONZACURE M-CDEA), trimethylene glycol di-p-aminobenzoate (VERSALINK 740M), and mixtures thereof. Preferably, the curing agent of the present invention includes 3,5-dimethylthio-2,4-toluenediamine and isomers thereof, such as ETHACURE 300, commercially available from Albermarle Corporation of Baton Rouge, La. Suitable polyamine curatives, which include both primary and secondary amines, preferably have molecular weights ranging from about 64 to about 2000. Preferably, n and m, each separately, have values of 1, 2, or 3, and preferably, 1 or 2.

At least one of a diol, triol, tetraol, hydroxy-terminated, may be added to the aforementioned polyurethane composition. Suitable hydroxy-terminated curatives have the following general chemical structure:

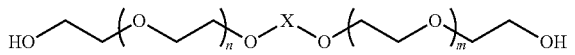

where n and m each separately have values of 0, 1, 2, or 3, and where X is ortho-phenylene, meta-phenylene, para-phenylene, ortho-cyclohexyl, meta-cyclohexyl, or para-cyclohexyl, or mixtures thereof. Preferably, n and m, each separately, have values of 1, 2, or 3, and more preferably, 1 or 2.

Preferred hydroxy-terminated curatives for use in the present invention include at least one of 1,3-bis(2-hydroxyethoxy)benzene and 1,3-bis-[2-(2-hydroxyethoxy)ethoxy]benzene, and 1,3-bis-{2-[2-(2-hydroxyethoxy)ethoxy]ethoxy}benzene; 1,4-butanediol; resorcinol-di-(β-hydroxyethyl)ether; and hydroquinone-di-(β-hydroxyethyl)ether; and mixtures thereof. Preferably, the hydroxy-terminated curatives have molecular weights ranging from about 48 to 2000. It should be understood that molecular weight, as used herein, is the absolute weight average molecular weight and would be understood as such by one of ordinary skill in the art. Both the hydroxy-terminated and amine curatives can include one or more saturated, unsaturated, aromatic, and cyclic groups. Additionally, the hydroxy-terminated and amine curatives can include one or more halogen groups. Suitable diol, triol, and tetraol groups include ethylene glycol, diethylene glycol, polyethylene glycol, propylene glycol, polypropylene glycol, lower molecular weight polytetramethylene ether glycol, and mixtures thereof. The polyurethane composition can be formed with a blend or mixture of curing agents. If desired, however, the polyurethane composition may be formed with a single curing agent.

The cover may alternatively comprise polyurea. In one embodiment, the polyurea prepolymer includes at least one diisocyanate and at least one polyether amine.

In this aspect of the invention the diisocyanate is preferably saturated, and can be selected from the group consisting of ethylene diisocyanate; propylene-1,2-diisocyanate; tetramethylene diisocyanate; tetramethylene-1,4-diisocyanate; 1,6-hexamethylene-diisocyanate; octamethylene diisocyanate; decamethylene diisocyanate; 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,2-diisocyanate; cyclohexane-1,3-diisocyanate; cyclohexane-1,4-diisocyanate; methyl-cyclohexylene diisocyanate; 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis(isocyanatomethyl)-cyclohexane diisocyanate; 4,4'-bis(isocyanatomethyl) dicyclohexane; 2,4'-bis(isocyanatomethyl)dicyclohexane; isophoronediisocyanate; triisocyanate of HDI; triisocyanate of 2,2,4-trimethyl-1,6-hexane diisocyanate; 4,4'-dicyclohexylmethane diisocyanate; 2,4-hexahydrotoluene diisocyanate; 2,6-hexahydrotoluene diisocyanate; and mixtures thereof. The saturated diisocyanate is preferably selected from the group consisting of isophoronediisocyanate, 4,4'-dicyclohexylmethane diisocyanate, 1,6-hexamethylene diisocyanate, or a combination thereof.

In another embodiment, the diisocyanate is an aromatic aliphatic isocyanate selected from the group consisting of meta-tetramethylxylene diisocyanate; para-tetramethylxylene diisocyanate; trimerized isocyanurate of polyisocyanate; dimerized uredione of polyisocyanate; modified polyisocyanate; and mixtures thereof.

The polyether amine may be selected from the group consisting of polytetramethylene ether diamines, polyoxypropylene diamines, poly(ethylene oxide capped oxypropylene) ether diamines, triethyleneglycoldiamines, propylene oxide-based triamines, trimethylolpropane-based triamines, glycerin-based triamines, and mixtures thereof. In one embodiment, the polyether amine has a molecular weight of about 1000 to about 3000.

The curing agent may be selected from the group consisting of hydroxy-terminated curing agents, amine-terminated curing agents, and mixtures thereof, and preferably has a molecular weight from about 250 to about 4000.

In one embodiment, the hydroxy-terminated curing agents are selected from the group consisting of ethylene glycol; diethylene glycol; polyethylene glycol; propylene glycol; 2-methyl-1,3-propanediol; 2-methyl-1,4-butanediol; dipropylene glycol; polypropylene glycol; 1,2-butanediol; 1,3-butanediol; 1,4-butanediol; 2,3-butanediol; 2,3-dimethyl-2,3-butanediol; trimethylolpropane; cyclohexyldimethylol; triisopropanolamine; tetra-(2-hydroxypropyl)-ethylene diamine; diethylene glycol di-(aminopropyl)ether; 1,5-pentanediol; 1,6-hexanediol; 1,3-bis-(2-hydroxyethoxy)cyclohexane; 1,4-cyclohexyldimethylol; 1,3-bis-[2-(2-hydroxyethoxy)ethoxy]cyclohexane; 1,3-bis-{2-[2-(2-hydroxyethoxy)ethoxy]ethoxy}cyclohexane; trimethylolpropane; polytetramethylene ether glycol, preferably having a molecular weight from about 250 to about 3900; and mixtures thereof.

The amine-terminated curing agents may be selected from the group consisting of ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; imido-bis-propylamine; monoethanolamine, diethanolamine; triethanolamine; monoisopropanolamine, diisopropanolamine; isophoronediamine; and mixtures thereof.

In one embodiment, the composition further includes a catalyst that can be selected from the group consisting of a bismuth catalyst, zinc octoate, di-butyltin dilaurate, di-butyltin diacetate, tin (II) chloride, tin (IV) chloride, di-butyltin dimethoxide, dimethyl-bis[1-oxonedecyl)oxy]stannane, di-n-octyltin bis-isooctyl mercaptoacetate, triethylenediamine, triethylamine, tributylamine, oleic acid, acetic acid; delayed catalysts, and mixtures thereof. The catalyst may be present from about 0.005 percent to about 1 percent by weight of the composition.

Any method available to one of ordinary skill in the art may be used to combine the polyisocyanate, polyol or polyamine, and curing agent of the present invention. One commonly employed method, known in the art as a one-shot method, involves concurrent mixing of the polyisocyanate, polyol or polyether amine, and curing agent. This method results in a mixture that is inhomogeneous (more random) and affords the manufacturer less control over the molecular structure of the resultant composition. A preferred method of mixing is known as the prepolymer method. In this method, the polyisocyanate and the polyol or polyether amine are mixed separately prior to addition of the curing agent. This method seems to afford a more homogeneous mixture resulting in a more consistent polymer composition.

As mentioned above, the cover layer may also comprise ionomeric materials, such as ionic copolymers of ethylene and an unsaturated monocarboxylic acid, which are available under the trademark SURLYN® of E.I. DuPont de Nemours & Co., of Wilmington, Del., or IOTEK® or ESCOR® of Exxon. These are copolymers or terpolymers of ethylene and methacrylic acid or acrylic acid totally or partially neutralized, i.e., from about 1 to about 100 percent, with salts of zinc, sodium, lithium, magnesium, potassium, calcium, manganese, nickel or the like. In one embodiment, the carboxylic acid groups are neutralized from about 10 percent to about 100 percent. The carboxylic acid groups may also include methacrylic, crotonic, maleic, fumaric or itaconic acid. The salts are the reaction product of an olefin having from 2 to 10 carbon atoms and an unsaturated monocarboxylic acid having 3 to 8 carbon atoms.

The cover layer may also include at least one ionomer, such as acid-containing ethylene copolymer ionomers, including E/X/Y terpolymers where E is ethylene, X is an acrylate or methacrylate-based softening comonomer present in about 0 to 50 weight percent and Y is acrylic or methacrylic acid present in about 5 to 35 weight percent. The ionomer may include so-called "low acid" and "high acid" ionomers, as well as blends thereof. In general, ionic copolymers including up to about 15 percent acid are considered "low acid" ionomers, while those including greater than about 15 percent acid are considered "high acid" ionomers. "Low acid" ionomers may be combined with a softening comonomer such as vinyl esters of aliphatic carboxylic acids wherein the acids have 2 to 10 carbon atoms, vinyl ethers wherein the alkyl groups contains 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, and butyl methacrylate, and are believed to impart high spin to golf balls.

Covers comprising "high acid" ionomers are believed to impart low spin and longer distance to golf balls. A cover of the present invention may comprise about 15 to about 35 weight percent acrylic or methacrylic acid, making the ionomer a high modulus ionomer. An additional comonomer such as an acrylate ester (i.e., iso- or n-butylacrylate, etc.) can also be included to produce a softer terpolymer. The additional comonomer may be selected from the group consisting of vinyl esters of aliphatic carboxylic acids wherein the acids have 2 to 10 carbon atoms, vinyl ethers wherein the alkyl groups contains 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, butyl methacrylate, or the like.

The core of the present invention may comprise a polymer such as ionomeric copolymers and terpolymers, thermoset materials, ionomer precursors, thermoplastics, thermoplastic elastomers, polybutadiene rubber, balata, grafted metallocene-catalyzed polymers, single-site polymers, high-crystalline acid polymers, cationic ionomers, and mixtures thereof. The core may be colored or may be transparent or translucent. As used herein, and as discussed in commonly-owned U.S. Patent Publication No. 2007/0149323, previously incorporated by reference, the term "core" refers to any portion of the golf ball surrounded by the cover.

In the case of a golf ball comprising three layers, the core is the portion including at least the inner-most center layer and the intermediate layer, also referred to as the outer core layer, immediately surrounding the center.

In accordance with the present invention, the intermediate or outer core layer may comprise a solid polymeric material or may be a layer of wound elastomeric material. An intermediate or outer core layer comprising a solid polymeric material may be colored or may be transparent or translucent.

A golf ball having a core comprising two layers may be referred to as a "dual core" or a "multi-piece core." A golf ball of the present invention may also comprise a multi-piece core having more than two layers. The center of a dual core or multi-piece core may comprise a solid material or a fluid, i.e., a gas or liquid. The center may alternatively comprise a semi-solid such as a paste or gel.

A "clear" or "transparent" cover preferably has an average transmittance of visible light (e.g., between about 380 nm and about 770 nm or alternately between about 400 nm and about 700 nm) of at least about 40 percent, preferably at least about 60 percent, more preferably at least about 80 percent. The average transmittance referred to herein is typically measured for incident light normal (i.e., at approximately 90°) to the plane of the object and can be measured using any known light transmission apparatus and method, e.g., a UV-Vis spectrophotometer. A golf ball of the invention may comprise covers that are either entirely or partially clear or transparent as well.

A "translucent" cover preferably has an average transmittance of visible light (e.g., between about 380 nm and about 770 nm or alternately between about 400 nm and about 700 nm) of at least about 10 percent, preferably at least about 20 percent, more preferably at least about 30 percent. A golf ball of the invention may comprise covers that are either entirely or partially translucent as well.

In one embodiment, the transparent or translucent cover comprises a plurality of dimples on its surface as well as surface off-sets other than dimples. The surface off-sets may be artifacts from the casting or molding of the cover. For example, during injection molding, a golf ball core or precursor is placed within a molding cavity comprising two hemispheres. The core or precursor is supported by pins so that it maintains its position in the center of the golf ball. Molten cover material is then injected into the molding cavity through apertures or gates and surrounds the core or precursor to harden and form the cover. As the molten cover material envelops the core or precursor, the supporting pins retract, allowing the molten material to fill in the cavities created by the pins. The retraction of the pins often causes the formation of "witness lines" on the cover about the area where the pins meet the mold. Likewise, during compression molding of a cover, a parting line may form along the equator of the golf ball. In accordance with the present invention, the witness lines created on the cover by the injection molding process or the parting line resulting from compression molding may be maintained on the clear or translucent cover to create unique visual effects, such as the enhancement of shadows on the core of the ball.

In other embodiments, these artifacts from the manufacturing process may be removed by post-mold finishing processes such as vibration tumbling.

Other non-limiting examples of surface off-sets include a molded stripe, which can be co-molded to provide the stripe with a color different than the core or the intermediate layer, so that the ball may identified as a practice ball; a molded line to aid in putting alignment; logos or indicia; raised text or indicia; great circles; lines or line segments; polygons or other shapes; arcs or curves; or text. The molded elements described above may be depressed into the cover or may rise as projections away from the surface of the cover.

The surface of the golf ball may also include optically active sites detectable by a ball-launching mechanism to allow for launch monitor testing. The sites may be reflective in the visible or invisible range.

In another embodiment of the current invention, the cover may be cast or compression molded. This process involves the joining of two cover hemispheres at an equator. Additionally, other inventive aspects of the present invention, such as a cover comprising a transparent or translucent material and having an amount of pigment or dye or an amount of reflective particulates, may be incorporated into only one hemisphere of the golf ball cover.

Dye or pigment may be added to the cover material to create a golf ball having a translucent colored cover. In the case of a golf ball with depressions molded into the cover, the addition of dye to the clear cover material can help to enhance the shadow effect of the depressions incorporated on the surface of the cover. The dye may be a fluorescent dye.

In one aspect of the present invention, dyes or pigments may be added to any or all layers of the golf ball including, but not limited to, the cover and the core, the intermediate layer and any coating as well. The dyes or pigments may be inorganic or organic. In one embodiment, the pigments include effect pigments.

According to another embodiment, the cover may comprise reflective particulates to create the effect of sparkle, glitter, pearlescence or iridescence. The cover may contain reflective or optically active particulates such as described by Murphy in U.S. Pat. No. 5,427,378 which is incorporated herein by reference. Pearlescent pigments sold by the Mearle Corporation can also be used in this way. The reflective material may comprise at least one member selected from the group consisting of metal flake, iridescent glitter, metalized film and colored polyester foil.

In one embodiment of the present invention, the core may comprise a swirled color pattern achieved by mixing materials of different colors or different color shades during the manufacture of the core. The swirled pattern of the core can be created using the method described in U.S. Pat. No. 2,283,845, which is incorporated herein by reference in its entirety.

In a variation of the above embodiment, the core may be a multi-piece core having a center and an outer core layer visible through the transparent or translucent cover. Preferably, the outer core layer has a swirled appearance. The outer swirled core layer may comprise molded rubber or thermoplastic halves having a swirled pattern. The center of the multi-piece core may comprise rubber or a blend thereof, rubber regrind, filler, foam, liquid, or other suitable materials.

In another embodiment of the present invention, the core may be formed from a slug or prep or perform made from multiple segments of differently color shaded material. The slug may comprise at least three differently color shaded segments, and each color shade segment accounts for at least five percent of the total color coverage of the golf ball. The multi-color shaded slug is molded to form a multi-colored core.

The core may include a plurality of surface off-sets including ridges, raised edges, points or other projections on its outer surface. The clear or translucent cover is molded around the core by casting, injection molding, compression molding or other methods. The projections on the outer surface of the core provide more surface area for the adherence of the cover, decreasing the possibility of the separation or delamination of the cover from the core. The surface of the core may also include a plurality of depressions or valleys, also increasing surface area and so providing for better adhesion of the cover. The resulting ball is more durable than golf balls comprising smooth cores.

A golf ball of the present invention may alternatively comprise a clear or translucent cover, a core and an intermediate layer including a plurality of surface off-sets including ridges, raised edges, points or other projections on its outer surface. The clear or translucent cover is molded around the intermediate layer by casting, injection molding, compression molding or other methods. As in the above embodiment, the projections on the outer surface of the intermediate layer provide more surface area for the adherence of the cover, decreasing the possibility of the separation or delamination of the cover and core.

The transparent or translucent cover of the present invention may additionally act as a lens, magnifying the appearance of the core or intermediate layer below. Any text, logo or design printed on the core or intermediate layer will then also be magnified. More particularly, the transparent or translucent cover comprises a polymeric material having a magnification factor from about 2× to about 5× to make text or other markings printed on the surface of the layer immediately beneath the cover appear larger than its actual size. The actual size of any text or markings is typically small given the limited amount of space on the surface of the golf ball layer. Because a player may not be able to easily discern the fine text or marking, it is advantageous to magnify the physical appearance of the indicia. The magnified appearance of the core or intermediate layer or any marking on the surface of the core or intermediate layer may also enhance a player's ability to visualize the ball, and hence may improve a player's ability to strike the ball in the desired location.

The golf balls of the present invention may be painted, coated, or surface treated for further benefits. For example, trademarks or other indicia may be printed, i.e., pad-printed, transfer printed, decal or ink jet printed, on the inner layer such that they are visible through the translucent cover. Protective and decorative coating materials, as well as methods of applying such materials to the surface of a golf ball cover, are well known in the golf ball art. Generally, such coating materials comprise urethanes, urethane hybrids, epoxies, polyesters and acrylics. If desired, more than one coating layer can be used. Further discussion of finishing treatments may be found in parent application Ser. No. 11/707,493, which was previously incorporated by reference in its entirety.

Table I below illustrates several non-limiting embodiments of the invention. Specifically, Table I displays the construction and overall golf ball CIECAM color appearance model color characteristics for five prophetic golf balls GB I-GBV. GB I is a 1 piece golf ball wherein the core contributes a pink pigment to the overall golf ball color and the coating contributes a pink tint to the overall golf ball forming a golf ball having an overall golf ball pink color defined by the CIECAM Color Model characteristics a=72, b=13, h=10°, J=44 and C=73. GB II is a coated 2 piece golf ball wherein the core contributes a pink pigment to the overall golf ball color, the cover contributes a pink dye to the overall golf ball color, and the coating contributes a pink tint to the overall golf ball forming a golf ball having an overall golf ball pink color defined by the CIECAM Color Model characteristics a=74, b=16. h=12°, J=35, and C=76. GB III is a 2 piece golf ball wherein the core contributes a purple pigment to the overall golf ball color and the cover is translucent, forming a golf ball having an overall golf ball purple color defined by the CIECAM Color Model characteristics a=33, b=−32. h=316°, J=46, and C=47. GB IV is a 3 piece golf ball wherein the core is opaque, the intermediate layer contributes a purple pigment to the overall golf ball color and the cover is transparent to form a golf ball having an overall purple golf ball color defined by the CIECAM Color Model characteristics a=39, b=−21. h=331°, J=31, and C=44. Finally, GB V is a 3 piece golf ball wherein the core is opaque, the intermediate layer contributes a purple pigment to the overall golf ball color and the cover is pearlescent with a purple tinted coating to form a golf ball having an overall purple golf ball color defined by the CIECAM Color Model characteristics a=52, b=−26. h=334°, J=50, and C=58.

While the examples in Table I include pink or purple pigments, dyes or tints, the present invention contemplates that any color may be used in any of the core, intermediate layer, cover or a coating which will combine within the golf ball construction to create an over golf ball color within the CIECAM Color Model characteristic ranges disclosed herein. By non-limiting example, it is envisioned that a blue may be combined with a red which creates an over all golf ball color of purple within the CIECAM Color Model characteristic ranges disclosed herein.

TABLE I

OVERALL GOLF BALL CIECAM COLOR CHARACTERISTICS FOR FIVE GOLF BALL CONSTRUCTIONS

| | Golf Ball Construction & Overall GB CIECAM Color Characteristcs | | | | |
|---|---|---|---|---|---|
| | GB I Pink 1 Piece | GB II Pink Coated 2 piece GB | GB III Purple 2 piece GB | GB IV Purple Multi-layer GB | GB V Purple Coated Multilayer GB |
| Core | Pink pigment | Pink pigment | Purple pigment | Opaque | Opaque |
| Intermediate Layer | N/A | N/A | N/A | Purple pigment | Purple pigment |
| Cover | N/A | Pink dye | Translucent | Transparent | Pearlescent |
| Coating | Pink tint | Pink tint | N/A | N/A | Purple Tint |
| a | 72 | 74 | 33 | 39 | 52 |
| b | 13 | 16 | −32 | −21 | −26 |
| h° | 10 | 12 | 316 | 331 | 334 |
| J | 44 | 35 | 46 | 31 | 50 |
| C | 73 | 76 | 47 | 44 | 58 |

While it is apparent that the illustrative embodiments of the invention disclosed herein fulfill the objectives of the present invention, it is appreciated that numerous modifications and other embodiments may be devised by those skilled in the art. Additionally, features and/or elements from any embodiment may be used singly or in combination with other embodiments and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A golf ball, having an overall golf ball color of pink or purple expressed in the CIE CIECAM color system, comprising a core, a cover and an intermediate layer, wherein at least one of the core, intermediate layer and cover comprises a pigment, dye, or tint which contributes to the overall golf ball color, the overall golf ball color having a color shade that is located in the CIECAM hue circle and not located in the CIELAB a*b* hue circle; and the overall golf ball color having an a value, a b value and a hue angle value h expressed in the CIE CIECAM color system, wherein:

where the a value is from about 5 to about 57, then the b value is from about −1 to about −60 and the hue angle h is from about 271° to about 359°; or where the a value is from about 58 to about 95, then the b value is from about 1 to about 60 and the hue angle h is from about 1° to about 35°.

2. The golf ball of claim 1, wherein the overall golf ball color further has a J lightness value expressed in the CIE CIECAM color system of from about 15-90 and/or a C chroma value expressed in the CIE CIECAM color system of from about 30 to about 90.

3. The golf ball of claim 1, wherein the overall golf ball color further has a J lightness value expressed in the CIE CIECAM color system of from about 40-90 and/or a C chroma value expressed in the CIE CIECAM color system of from about 50 to about 90.

4. The golf ball of claim 1, wherein the cover comprises a material selected from the group comprising polyurethane, polyurea, and ionomer resins.

5. The golf ball of claim 1, wherein the pigment, dye or tint is fluorescent.

6. The golf ball of claim 1, wherein the pigment, dye or tint is inorganic or organic.

7. The golf ball of claim 1, wherein the cover further comprises particulate material selected from the group comprising metal flake, iridescent glitter, metalized film and colored polyester foil.

8. The golf ball of claim 1, wherein the cover comprises a material which is at least partially transparent, translucent or pearlescent.

9. The golf ball of claim 1, wherein the cover and the intermediate layer comprise a material which is at least partially transparent, translucent or pearlescent.

10. A golf ball, having an overall golf ball color of pink or purple expressed in the CIE CIECAM color system, comprising a core, a cover and an intermediate layer disposed between the core and the cover, wherein the cover is at least partially transparent and at least one of the cover and the intermediate layer comprises a pigment, dye or tint which contributes to the overall golf ball color, said overall golf ball color having a color shade that is located in the CIECAM hue circle and not located in the CIELAB a*b* hue circle and having an a value, a b value and a hue angle value h expressed in the CIE CIECAM color system, wherein:

where the a value is from about 5 to about 57, then the b value is from about −1 to about −60 and the hue angle h is from about 271° to about 359°; or where the a value is from about 58 to about 95, then the b value is from about 1 to about 60 and the hue angle h is from about 1° to about 35°.

11. The golf ball of claim 10, wherein the overall golf ball color further has a J lightness value expressed in the CIE CIECAM color system of from about 15-90 and/or a C chroma value expressed in the CIE CIECAM color system of from about 30 to about 90.

12. The golf ball of claim 10, wherein the overall golf ball color further has a J lightness value expressed in the CIE CIECAM color system of from about 40-90 and/or a C chroma value expressed in the CIE CIECAM color system of from about 50 to about 90.

13. A golf ball, having an overall golf ball color of pink or purple expressed in the CIE CIECAM color system, comprising a core, a cover and an intermediate layer disposed between the core and the cover, wherein the intermediate layer comprises a pigment or dye which contributes to the overall golf ball color, wherein the cover comprises a translucent material and a pigment or dye which contributes to the overall golf ball color, and wherein the surface of said cover is coated with a coating material which is at least partially transparent and comprises a tint which contributes to the overall golf ball color, the overall golf ball color having a color shade that is located in the CIECAM hue circle and not located in the CIELAB a*b* hue circle and having an a value, a b value and a hue angle value h expressed in the CIE CIECAM color system, wherein:

where the a value is from about 5 to about 57, then the b value is from about −1 to about −60 and the hue angle h is from about 271° to about 359°; or where the a value is from about 58 to about 95, then the b value is from about 1 to about 60 and the hue angle h is from about 1° to about 35°.

14. The golf ball of claim 13, wherein the overall golf ball color further has a J lightness value expressed in the CIE CIECAM color system of from about 15-90 and/or a C chroma value expressed in the CIE CIECAM color system of from about 30 to about 90.

15. The golf ball of claim 13, wherein the overall golf ball color further has a J lightness value expressed in the CIE CIECAM color system of from about 40-90 and/or a C chroma value expressed in the CIE CIECAM color system of from about 50 to about 90.

16. A golf ball, having an overall golf ball color of pink or purple expressed in the CIE CIECAM color system, comprising a core and a cover, wherein the cover comprises a pigment or dye which contributes to the overall golf ball color, and wherein the surface of said cover is coated with a coating material which is at least partially transparent and comprises a tint which contributes to the overall golf ball color, the overall golf ball color having a color shade that is located in the CIECAM hue circle and not located in the CIELAB a*b* hue circle and having an a value, a b value and a hue angle value h expressed in the CIE CIECAM color system, wherein:

where the a value is from about 5 to about 57, then the b value is from about −1 to about −60 and the hue angle h is from about 271° to about 359°; or where the a value is from about 58 to about 95, then the b value is from about 1 to about 60 and the hue angle h is from about 1° to about 35°.

17. The golf ball of claim 16, wherein the overall golf ball color further has a J lightness value expressed in the CIE CIECAM color system of from about 15-90 and/or a C chroma value expressed in the CIE CIECAM color system of from about 30 to about 90.

18. The golf ball of claim 16, wherein the overall golf ball color further has a J lightness value expressed in the CIE CIECAM color system of from about 40-90 and/or a C chroma value expressed in the CIE CIECAM color system of from about 50 to about 90.

19. A golf ball, having an overall golf ball color of pink or purple expressed in the CIE CIECAM color system, comprising a core and a cover wherein at least one of the core and the cover comprises a pigment, dye or tint which contributes to the overall golf ball color such that the overall golf ball color has a color shade that is located in the CIECAM hue circle and not located in the CIELAB a*b* hue circle and has an a value, a b value and a hue angle value h expressed in the CIE CIECAM color system, wherein:

where the a value is from about 5 to about 57, then the b value is from about −1 to about −60 and the hue angle h is from about 271° to about 359°; or where the a value is from about 58 to about 95, then the b value is from about 1 to about 60 and the hue angle h is from about 1° to about 35°.

20. The golf ball of claim 19, wherein the overall golf ball color further has a J lightness value expressed in the CIE CIECAM color system of from about 15-90 and/or a C chroma value expressed in the CIE CIECAM color system of from about 30 to about 90.

21. The golf ball of claim 19, wherein the overall golf ball color further has a J lightness value expressed in the CIE CIECAM color system of from about 40-90 and/or a C chroma value expressed in the CIE CIECAM color system of from about 50 to about 90.

22. A golf ball, having an overall golf ball color of pink or purple expressed in the CIE CIECAM color system, comprising a core, a cover and an intermediate layer, wherein at least one of the core, intermediate layer and cover comprises a pigment, dye, or tint which contributes to the overall golf ball color, the overall golf ball color having a color shade that is located in the CIECAM hue circle and not located in the CIELAB a*b* hue circle and having an a value, a b value and a hue angle value h expressed in the CIE CIECAM color system, wherein:

where the a value is from about 52 to about 58, then the b value is from about −30 to about 30 and the hue angle h is either from about 330° to about 359° or from about 1° to about 30°.

* * * * *